US011567427B2

(12) United States Patent
Inokuchi

(10) Patent No.: US 11,567,427 B2
(45) Date of Patent: Jan. 31, 2023

(54) REMAINING-TONER-AMOUNT DETECTING DEVICE AND IMAGE FORMING APPARATUS

(71) Applicant: Sumihiro Inokuchi, Kanagawa (JP)

(72) Inventor: Sumihiro Inokuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/662,881

(22) Filed: May 11, 2022

(65) Prior Publication Data

US 2022/0373926 A1 Nov. 24, 2022

(30) Foreign Application Priority Data

May 18, 2021 (JP) ..... JP2021-083703

(51) Int. Cl.
*G03G 15/08* (2006.01)
*G03G 15/00* (2006.01)

(52) U.S. Cl.
CPC ..... *G03G 15/0856* (2013.01); *G03G 15/086* (2013.01); *G03G 15/0848* (2013.01); *G03G 15/0863* (2013.01); *G03G 15/556* (2013.01); *G03G 2215/0888* (2013.01)

(58) Field of Classification Search
CPC ..... G03G 15/0848; G03G 15/0856; G03G 15/086; G03G 15/0863; G03G 15/556; G03G 2215/0888
See application file for complete search history.

(56) References Cited

U.S. PATENT DOCUMENTS

2009/0066987 A1 3/2009 Inokuchi
2009/0252515 A1* 10/2009 Hotogi ..... G03G 15/0856 399/55
2013/0308965 A1* 11/2013 Tsuchiya ..... G03G 15/086 399/27
2014/0037305 A1* 2/2014 Monde ..... G03G 15/0856 399/27

FOREIGN PATENT DOCUMENTS

JP 11-065259 3/1999
JP 2001-194910 7/2001
JP 2011-215566 10/2011

* cited by examiner

*Primary Examiner* — Joseph S Wong
(74) *Attorney, Agent, or Firm* — IPUSA, PLLC

(57) ABSTRACT

A remaining-toner-amount detecting device includes: first sensor disposed at a supply channel for a toner; a second sensor disposed at a location different from the supply channel; detection processing that compares a capacitance detected by the first sensor with a determination threshold value to detect a toner end; and a memory that stores a capacitance detected by the second sensor in an initial period as initial reference data, and a capacitance detected by the second sensor after part replacement as post-replacement reference data. The detection processing circuitry sets, based on the initial reference data, the determination threshold value as an initial determination threshold value in the initial period, and re-sets the determination threshold value, from the initial determination threshold value, to a value based on the post-replacement reference data, as a post-replacement reference data after the part replacement.

20 Claims, 6 Drawing Sheets

REMAINING-TONER-AMOUNT DETECTING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2021-083703, filed on May 18, 2021, in the Japan Patent Office, the entire disclosure of which is hereby incorporated by reference herein.

BACKGROUND

Technical Field

The present disclosure relates to a remaining-toner-amount detecting device and an image forming apparatus.

Description of the Related Art

There is known an image forming apparatus including a remaining-toner-amount detecting device that detects an amount of remaining toner. The remaining-toner-amount detecting device detects a state of a toner supplied to a supply channel to determine a toner end that indicates a decrease in amount of supplied toner and to prompt a user to replace a toner bottle.

There is known an image forming apparatus that compares a detection result obtained by a detection sensor such as a magnetic permeability sensor with a determination threshold value (e.g., a toner empty determination threshold value) to determine the toner end. This image forming apparatus corrects the determination threshold value in accordance with temperature-humidity information, average coverage rate information of output jobs, life information of a developer, or an amount of remaining toner in a replaceable toner storage container.

SUMMARY

Example embodiments include a remaining-toner-amount detecting device, including: a first sensor disposed at a supply channel for a toner; a second sensor disposed at a location different from the supply channel; detection processing circuitry configured to compare a capacitance detected by the first sensor with a determination threshold value to detect a toner end; and a memory that stores a capacitance detected by the second sensor in an initial period as initial reference data, and a capacitance detected by the second sensor after part replacement as post-replacement reference data. The detection processing circuitry sets, based on the initial reference data, the determination threshold value as an initial determination threshold value in the initial period, and re-sets the determination threshold value, from the initial determination threshold value, to a value based on the post-replacement reference data, as a post-replacement reference data after the part replacement.

Example embodiments include a remaining-toner-amount detecting device, including: first capacitance detecting means for detecting a capacitance at a supply channel for a toner; second capacitance detecting means for detecting a capacitance at a location different from the supply channel; remaining-amount detecting means for detecting a toner end based on comparison between the capacitance detected by the first detecting means and a determination threshold value; and storage means for storing a value of the capacitance detected by the second capacitance detecting means in an initial period as initial reference data, and a value of a capacitance detected by the second capacitance detecting means after part replacement as post-replacement reference data. The remaining-amount detecting means sets, based on the initial reference data, the determination threshold value as an initial determination threshold value in the initial period, and re-sets the determination threshold value, from the initial determination threshold value, to a value based on the post-replacement reference data, as a post-replacement reference data after the part replacement.

Example embodiments include an image forming apparatus including any one of the above-described remaining-toner-amount detecting devices.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
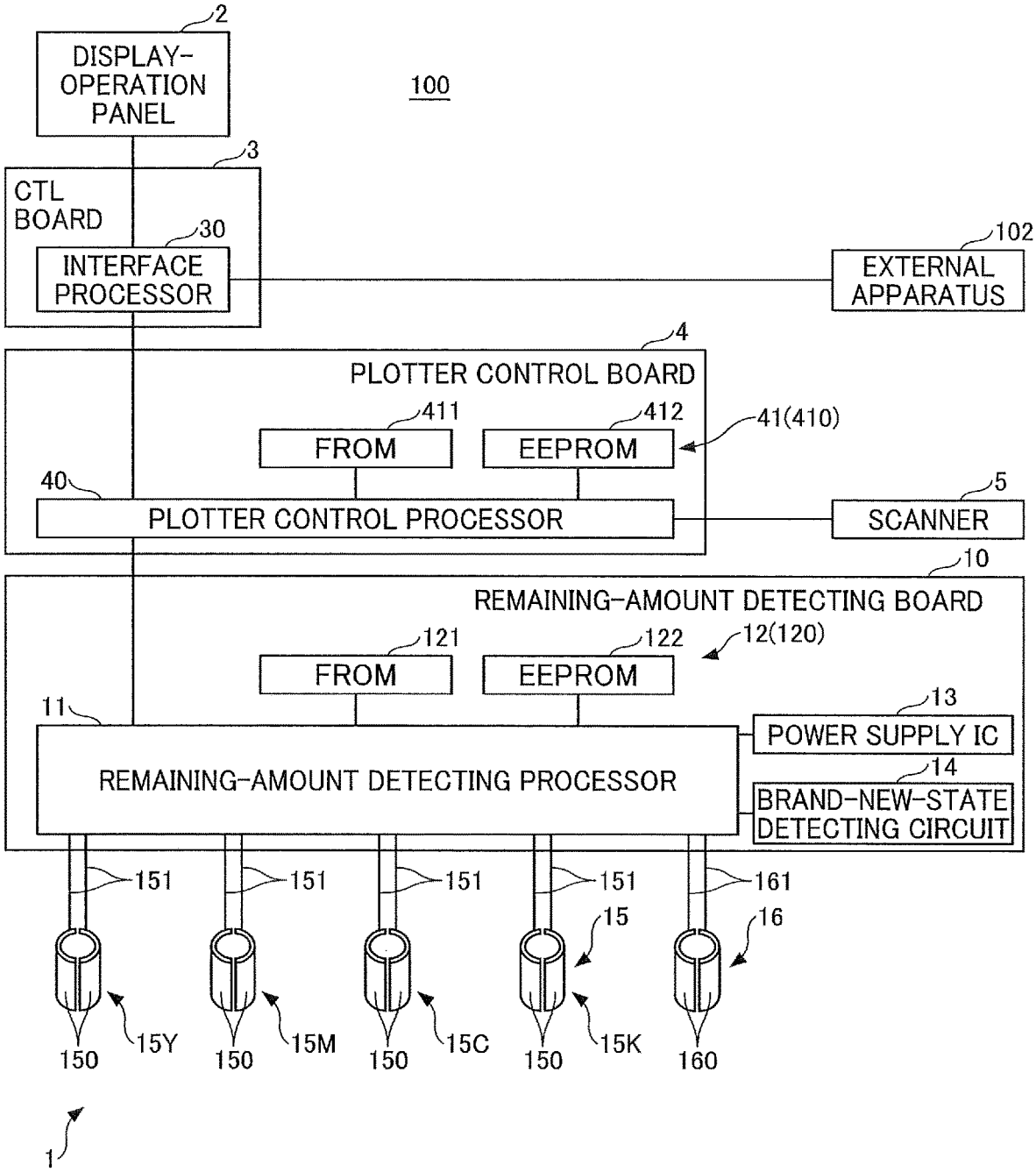
FIG. 1 is a block diagram illustrating a remaining-toner-amount detecting device and an image forming apparatus according to one embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. Referring now to the drawings, embodiments of the present disclosure are described below. As used herein, the singular forms "a," "an," and "the" are intended to include the plural forms as well, unless the context clearly indicates otherwise.

Embodiments of the present disclosure will be described below with reference to the accompanying drawings. Throughout the drawings, identical or similar components are denoted by identical or similar reference signs to omit redundant description as appropriate.

The embodiments below illustratively present a remaining-toner-amount detecting device and an image forming apparatus for embodying the technical spirit of the present disclosure and do not limit the present disclosure thereto. Dimensions, materials, shapes, relative arrangements, and the like of constituent parts described below should not be construed as limiting the scope of the present disclosure thereto and are intended to be merely illustrative unless otherwise noted. Dimensions, positional relationships, and the like of members illustrated in the drawings are sometimes exaggerated to clarify the description.

FIG. 1 is a block diagram illustrating a remaining-toner-amount detecting device 1 and an image forming apparatus 100 according to one embodiment of the present disclosure. The remaining-toner-amount detecting device 1 is a component that detects an amount of remaining toner in the image forming apparatus 100. The image forming apparatus 100 includes the remaining-toner-amount detecting device 1 in a housing thereof. The image forming apparatus 100 prints an image of interest on a printing medium. Examples of the image forming apparatus 100 include a copier, a printer, and a facsimile machine.

The image forming apparatus 100 causes toners of four colors (e.g., yellow, magenta, cyan, and black) to attach to a printing medium to form a color image on the printing medium. Alternatively, the image forming apparatus 100 may cause a toner of one color (e.g., black) to attach to a printing medium or may cause toners of any number of colors to attach to a printing medium. Examples of the printing medium include, but not limited to, a sheet-like member such as paper or a plastic sheet.

The image forming apparatus 100 includes a display-operation panel 2, a controller (CTL) board 3, and a plotter control board 4. The image forming apparatus 100 also includes a remaining-amount detecting board 10 that is a constituent part of the remaining-toner-amount detecting device 1. The boards may be parts different from each other or may be an integrated part of any appropriate combination of the boards.

The display-operation panel 2 is a part that displays a state of the image forming apparatus 100 and that is operated directly by a service person or user. As the display-operation panel 2, a touch panel can be used. In response to any of toners of four colors running out, the display-operation panel 2 displays a message that prompts the service person or user to replace the toner, and thus informs the service person or user of the running-out of the toner. The display-operation panel 2 may include a discrete display panel and a discrete operation panel.

The CTL board 3 includes one or more interface (I/F) processors (e.g., I/F central processing units (CPUs)) 30, an input/output interface, and an electronic circuit. The CTL board 3 is coupled to the display-operation panel 2 and an external apparatus 102 (e.g., a personal computer (PC)), external to the image forming apparatus 100, to enable communication of information between the display-operation panel 2 and the external apparatus 102. Through the CTL board 3, the image forming apparatus 100 sends output information (such as information on an amount of remaining toner or information for prompting the service person or user to replace a toner) of the remaining-toner-amount detecting device 1 to the display-operation panel 2 or the external apparatus 102.

The plotter control board 4 includes one or more plotter control processors (e.g., plotter CPUs) 40, a memory 41, an input/output interface, and an electronic circuit. The memory 41 may be implemented by a volatile memory such as a random access memory (RAM), a nonvolatile memory 410 such as a flash read-only memory (FROM) 411, and/or an electrically erasable programmable read-only memory (EEPROM) 412. The memory 41 implements a storage unit of the plotter control board 4. The FROM 411 of the plotter control board 4 stores a program for controlling printing of an image performed by the image forming apparatus 100. Each of the plotter control processors 40 reads the program from the FROM 411 and executes the program, so as to form an image.

The EEPROM 412 is removably installed on the plotter control board 4. The EEPROM 412 stores information specific to the image forming apparatus 100. Examples of the specific information include identification information, various kinds of part information, a print log, a maintenance log, and calibration information. For example, when the plotter control board 4 has a fault, the service person removes the EEPROM 412 and installs the EEPROM 412 on the replacement plotter control board 4. Thus, the replacement plotter control board 4 can easily obtain the information specific to the image forming apparatus 100.

In the image forming apparatus 100, a scanner 5 may be coupled to the plotter control board 4. Under the control of a scanner controller (such as circuitry), the scanner 5 obtains a scanned image of an original positioned in the scanner 5 by the user. The plotter control board 4 prints information of the scanned image sent from the scanner 5 so as to copy the scanned image. In the image forming apparatus 100, the scanner 5 may be coupled to the CTL board 3.

In the image forming apparatus 100, the remaining-toner-amount detecting device 1 is coupled to the plotter control board 4. The remaining-toner-amount detecting device 1 includes the remaining-amount detecting board 10, toner-detecting capacitive sensors (first sensors) 15 installed in respective supply channels 8 (see FIG. 2) for toners of four colors, and a reference capacitive sensor (second sensor) 16. When configurations for the toners of four colors are individually described below, Y, M, C, and K are respectively added for the configuration for the yellow toner, the configuration for the magenta toner, the configuration for the cyan toner, and the configuration for the black toner as appropriate in the description. That is, the four toner-detecting capacitive sensors 15 are constituted by a yellow-toner-detecting capacitive sensor 15Y, a magenta-toner-detecting capacitive sensor 15M, a cyan-toner-detecting capacitive sensor 15C, and a black-toner-detecting capacitive sensor 15K. The first sensors 15 are each an example of first capacitance detecting means, and the second sensor 16 is an example of second capacitance detecting means.

The remaining-amount detecting board 10 implements detection processing circuitry that performs a remaining-toner-amount detection process, and an example of remaining-amount detecting means. The remaining-amount detecting board 10 includes one or more remaining-amount detecting processors 11, a memory 12, a power supply integrated circuit (IC) 13, a brand-new-state detecting circuit 14, an input/output interface, and an electronic circuit.

The remaining-amount detecting processors 11 are a main processing constituent, of the remaining-amount detecting board 10, that executes a detection program stored in the memory 12. The remaining-amount detecting processors 11 are constituted by one or more circuits selected from a CPU, an application specific integrated circuit (ASIC), a field programmable gate array (FPGA), and a plurality of discrete semiconductor chips.

The memory 12 may be implemented by a volatile memory such as a RAM, and/or a nonvolatile memory 120 such as an FROM 121 and an EEPROM 122. The memory 12 implements a storage unit of the remaining-amount detecting board 10. Part of the memory 12 may be built in each of the remaining-amount detecting processors 11. The memory 12 is an example of storage means.

The FROM 121 of the remaining-amount detecting board 10 stores the aforementioned detection program. The EEPROM 122 is removably installed on the remaining-amount detecting board 10. The EEPROM 122 stores information specific to the remaining-toner-amount detecting device 1. Examples of the specific information include identification information, various kinds of part information, toner information, and calibration information. For example, when the remaining-amount detecting board 10 has a fault, the service person removes the EEPROM 122 and installs the EEPROM 122 on the replacement remaining-amount detecting board 10. Thus, the replacement remaining-amount detecting board 10 can easily obtain the information specific to the remaining-toner-amount detecting device 1.

The power supply IC 13 supplies electric power to the remaining-amount detecting board 10. For example, the power supply IC 13 supplies electric power for operation to the remaining-amount detecting processors 11. The remaining-amount detecting processors 11 then apply a voltage for measuring a capacitance to the toner-detecting capacitive sensors 15 and the reference capacitive sensor 16.

When the remaining-amount detecting board 10 is replaced, the brand-new-state detecting circuit 14 detects the new remaining-amount detecting board 10 (in a brand new state). For example, the brand-new-state detecting circuit 14 includes a fuse. When the remaining-amount detecting board 10 is in use or is replaced, the brand-new-state detecting circuit 14 causes a large current to flow through the fuse so as to make the fuse open. In this manner, the brand-new-state detecting circuit 14 changes the state of the remaining-amount detecting board 10 from the brand new state to the used state. Thus, the remaining-amount detecting processors 11 detect the closed fuse (e.g., part replacement information) of the brand-new-state detecting circuit 14 to be able to recognize that the remaining-amount detecting board 10 is in the brand new state.

Figure 2:
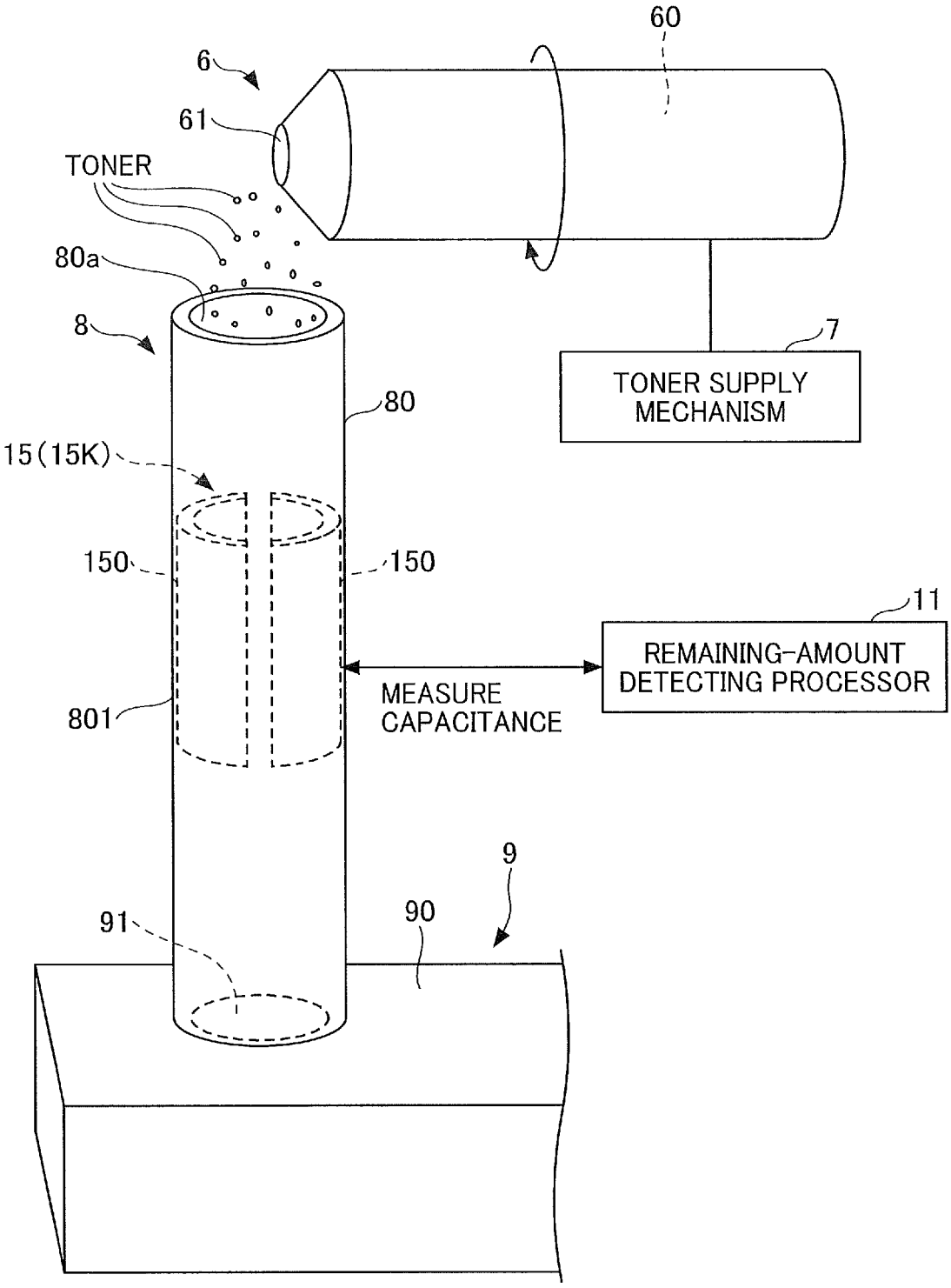
FIG. 2 is a schematic diagram illustrating a configuration for supplying a black toner and a toner-detecting capacitive sensor.

Each of the four toner-detecting capacitive sensors 15 detects a change in capacitance according to a state of the corresponding toner. FIG. 2 is a schematic diagram illustrating a configuration for supplying the black toner and the toner-detecting capacitive sensor 15. How the black toner is supplied and how the toner state is detected will be described next with reference to FIG. 2. Since configurations and operations for the yellow, magenta, and cyan toners can be identical or similar to those for the black toner, description thereof is omitted.

As the configuration for supplying the black toner, the image forming apparatus 100 includes a toner bottle 6, a toner supply mechanism 7, the supply channel 8, and a developing device 9.

The toner bottle 6 has a cylindrical shape and thus has a storage space 60 therein. The toner bottle 6 contains the toner in this storage space 60. The toner bottle 6 has a spiral protrusion on an inner circumferential surface thereof. The toner bottle 6 also has, at one end in an axial direction, an outflow port 61 through which the toner flows out from the storage space 60. The user of the image forming apparatus 100 installs the toner bottle 6 to the toner supply mechanism 7 at the time of toner replacement. In the image forming apparatus 100, when the toner bottle 6 is installed, the outflow port 61 is located right above the supply channel 8 in the vertical direction.

The toner supply mechanism 7 includes a motor whose operation is controlled by the plotter control board 4. The toner supply mechanism 7 rotates the installed toner bottle 6 axially. Due to the rotating operation of the toner supply mechanism 7, the spiral protrusion on the inner circumferential surface of the toner bottle 6 rotates, so that the toner in the storage space 60 is guided to the outflow port 61 and falls from the outflow port 61 into the supply channel 8.

The supply channel 8 is located between the outflow port 61, which is upstream in a toner flow direction, and the developing device 9, which is downstream in the toner flow direction. The supply channel 8 retains the toner and sends out the toner. The supply channel 8 is constituted by a passage member 80 that has a passage 80*a* for the toner. The passage member 80 has a tubular portion 801 extending in the vertical direction in at least portion thereof. The remaining-toner-amount detecting device 1 has the toner-detecting capacitive sensor 15 at this tubular portion 801.

The toner-detecting capacitive sensor 15 includes a pair of detection electrodes 150 and a pair of electric wires 151 (see FIG. 1) that couple the respective detection electrodes 150 and the remaining-amount detecting board 10 (specifically, the remaining-amount detecting processor 11) to each other.

Each of the detection electrodes 150 is constituted by a conductive member such as a metal plate that is bent to fit the inner circumferential surface of the passage 80*a*. Thus, each of the detection electrodes 150 has a semi-cylindrical shape as a whole. The pair of detection electrodes 150 are exposed to the passage 80*a* of the tubular portion 801, face each other in a non-contact manner, and have the same vertical-direction length. That is, the pair of detection electrodes 150 are attached toh the passage 80*a* for the toner interposed therebetween, so as to constantly capture a change in capacitance in the passage 80*a*. The shape of the pair of detection electrodes 150 is not limited to the semi-cylindrical shape. The pair of detection electrodes 150 may have any shape (such as a flat-plate shape or a disc shape) in accordance with the shape of the supply channel 8.

As the pair of electric wires 151, a harness, a relay board, or the like is used. The remaining-amount detecting processor 11 applies an appropriate voltage across the pair of detection electrodes 150 through the pair of electric wires 151 and detects a change in capacitance between the pair of detection electrodes 150. The toner-detecting capacitive sensor 15 may include a detecting circuit coupled to the pair of detection electrodes 150. Based on an instruction from the remaining-amount detecting processor 11, the detecting circuit may measure the capacitance and transmit a measurement result to the remaining-amount detecting processor 11. One of the pair of detection electrodes 150 of the toner-detecting capacitive sensor 15 may be grounded, and the other of the pair of detection electrodes 150 may be coupled to the remaining-amount detecting processor 11.

The developing device 9 includes a container 90 into which the toner flows from the supply channel 8, and a motor drive mechanism (such as a motor driving circuit) disposed in the container 90. The container 90 has an inflow port 91 coupled to the supply channel 8. The developing device 9 sends out the toner that has fallen from the toner bottle 6 into the supply channel 8 and has accumulated in the supply channel 8, into the container 90 through the inflow port 91 during driving of the motor drive mechanism. That is, the height of the accumulated toner (accumulation state or filling degree) in the supply channel 8 that extends in the vertical direction changes in accordance with a balance between an amount of toner supplied from the toner bottle 6 and an amount of toner sent out toward the developing device 9.

The remaining-amount detecting processor 11 receives a measurement result (e.g., a measured waveform of the capacitance) obtained by each of the toner-detecting capacitive sensors 15, and recognizes an amount of toner and an amount of air present between the pair of detection electrodes 150. When the toner bottle 6 becomes empty, the toner no longer falls into the supply channel 8 even if the toner bottle 6 rotates. Consequently, the toner in the supply channel 8 decreases. Thus, based on the measurement result obtained by the toner-detecting capacitive sensor 15 during the rotation of the toner bottle 6, the remaining-amount detecting processor 11 is able to detect a toner end that indicates that the amount of toner supplied from the toner bottle 6 has decreased or is zero.

Specifically, the remaining-amount detecting processor 11 compares the measurement result obtained by the toner-detecting capacitive sensor 15 with a determination threshold value Th to determine the toner end. The determination threshold value Th is set before the toner is supplied to the supply channel 8 and is stored in the nonvolatile memory 410.

Figure 3:
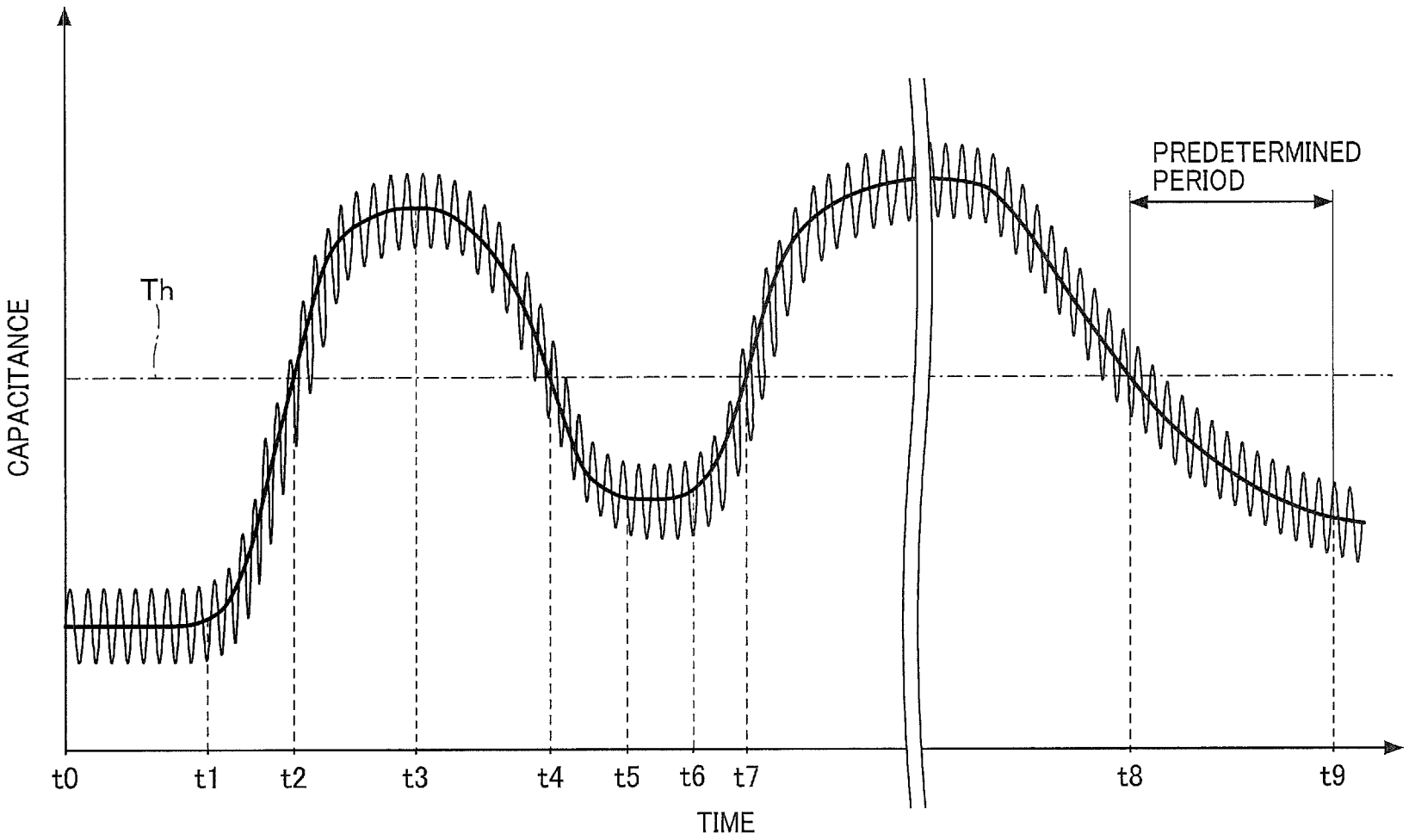
FIG. 3 is a graph schematically illustrating a measured waveform obtained by the toner-detecting capacitive sensor.

FIG. 3 is a graph schematically illustrating a measured waveform obtained by the toner-detecting capacitive sensor 15. In this graph, the horizontal axis represents time and the vertical axis represents the capacitance value. A change in capacitance detected by the toner-detecting capacitive sensor 15 in response to supply of the toner and how the toner end is detected will be described next with reference to FIG. 3.

In an initial period (from a time point t0 to a time pint t1 in FIG. 3) from shipment of the image forming apparatus 100 from a factory to installation of the toner bottle 6, no toner has stuck to the supply channel 8 of the image forming apparatus 100. Thus, in response to booting of the image forming apparatus 100 in the initial period, the remaining-amount detecting processor 11 obtains the smallest value as the measurement result obtained by the toner-detecting capacitive sensor 15. As illustrated in FIG. 3, the measured waveform obtained by the toner-detecting capacitive sensor 15 repeatedly fluctuates with a small amplitude in the capacitance direction (vertical axis) as time passes. Thus, the remaining-amount detecting processor 11 calculates an average value (such as a moving average) or a median value of the amplitude of the measured waveform of the capacitance obtained by the toner-detecting capacitive sensor 15 and uses the calculated value as the capacitance value.

At and after the time point tl when the user installs the toner bottle 6, the toner is supplied into the supply channel 8 in response to the rotation of the toner bottle 6 by the toner supply mechanism 7 in the image forming apparatus 100. As the supply channel 8 is filled with the toner, the capacitance detected by the toner-detecting capacitive sensor 15 increases. The remaining-amount detecting processor 11 determines a toner present state based on this capacitance becoming larger than or equal to the determination threshold value Th (see a time point t2), and sends information indicating the toner present state to the plotter control processor 40.

If the supply of the toner from the toner bottle 6 is continued in the toner present state, an abnormality may occur because of an oversupply of the toner. Thus, in the toner present state, the plotter control processor 40 causes the developing device 9 to operate, so as to prioritize sending of the toner from the supply channel 8 to the developing device 9. Consequently, the height of the accumulated toner in the supply channel 8 gradually decreases, and the capacitance detected by the toner-detecting capacitive sensor 15 decreases accordingly (see a time point t3 to a time point t4).

At the time point t4 when the capacitance detected by the toner-detecting capacitive sensor 15 falls below the determination threshold value Th, the remaining-amount detecting processor 11 determines a toner absent state in which the height of the accumulated toner in the supply channel 8 has decreased. In this state, however, a little toner remains in the supply channel 8, that is, sticking of the toner has occurred. Thus, at a time point t5 when the height of the accumulated toner becomes lower than the pair of detection electrodes 150, the toner-detecting capacitive sensor 15 continuously measures a capacitance value larger than that measured in the initial period.

If the information sent from the remaining-amount detecting processor 11 indicates the toner absent state (for example, at a time point t6), the plotter control processor 40 causes the toner supply mechanism 7 to operate, so that the toner is supplied from the toner bottle 6 to the supply channel 8. As the supply channel 8 is filled with the toner, the capacitance detected by the toner-detecting capacitive sensor 15 increases. The remaining-amount detecting processor 11 determines the toner present state again based on the capacitance becoming larger than or equal to the determination threshold value Th (see a time point t7). That is, based on the information indicating the toner present state or the toner absent state sent from the remaining-amount detecting processor 11, the image forming apparatus 100 controls whether to supply or stop supplying the toner from the toner bottle 6 and whether to send or stop sending the toner to the developing device 9.

The image forming apparatus 100 continues image forming in which the developing device 9 causes the toner to attach. When the toner bottle 6 becomes empty, the toner is no longer accumulated in the supply channel 8 even if the toner supply mechanism 7 operates. For example, at a time point t8, the remaining-amount detecting processor 11 determines that the capacitance detected by the toner-detecting capacitive sensor 15 falls below the determination threshold value Th. If the remaining-amount detecting processor 11 determines that the capacitance is continuously below the determination threshold value Th for a predetermined period (beyond a time point t9 which is the sum of the time point t8 and a period threshold value), the remaining-amount detecting processor 11 detects the toner end for prompting the service person or user to replace the toner bottle 6.

As described above, the determination threshold value Th used by the image forming apparatus 100 (the remaining-toner-amount detecting device 1) serves as a toner-supply-send-out determination threshold value for determining the operation of the toner supply mechanism 7 and the operation of the developing device 9 and also as a toner-end determination threshold value for determining the toner end. The remaining-toner-amount detecting device 1 may separately have the toner-supply-send-out determination threshold value and the toner-end determination threshold value. Also in this case, a method for setting the determination threshold value Th, which will be described later, can be used to set the toner-supply-send-out determination threshold value and the toner-end determination threshold value.

Referring back to FIGS. 1 and 2, the method for setting the determination threshold value Th will be described next. Sticking of the toner to the supply channel 8 occurs once the image forming apparatus 100 supplies the toner to the supply channel 8. Thus, the remaining-toner-amount detecting device 1 sets the determination threshold value Th based on the capacitance detected by each toner-detecting capacitive sensor 15 at the time of booting in the initial period. The initial period is a period from shipment of the image forming apparatus 100 from a factory to installation of the toner bottle 6 in the image forming apparatus 100.

If a part of the remaining-toner-amount detecting device 1 is replaced in maintenance or the like of the image forming apparatus 100, the measurement result obtained by each toner-detecting capacitive sensor 15 may change from the measurement result obtained before the replacement because of a part variation of the electronic part (such as the remaining-amount detecting processor 11 or the power supply IC 13). Thus, the remaining-toner-amount detecting device 1 uses a measurement result of the capacitance obtained by the reference capacitive sensor 16 to set, as the determination threshold value Th, an initial determination threshold value Th1 and a post-replacement determination threshold value Th2.

Specifically, the reference capacitive sensor 16 includes a pair of reference electrodes 160 and a pair of electric wires 161 that couple the respective reference electrodes 160 and the remaining-amount detecting board 10 (specifically, the remaining-amount detecting processor 11) to each other.

The reference electrodes 160 have the same shape (i.e., the semi-cylindrical shape) as the detection electrodes 150. The pair of reference electrodes 160 face each other in a non-contact manner at the same interval as that of the pair of detection electrodes 150. That is, capacitance detection specifications of the pair of reference electrodes 160 are set to be the same as those of the pairs of detection electrodes 150.

However, a position where the pair of reference electrodes 160 are installed is different from the positions (the supply channels 8 for the respective toners) where the pairs of detection electrodes 150 are installed. For example, in the remaining-toner-amount detecting device 1, the pair of reference electrodes 160 are fixed to a tubular case that has the same shape as the tubular portion 801 of the passage member 80, so that the pair of reference electrodes 160 are isolated from the internal structure (e.g., the supply channels 8) of the image forming apparatus 100 and from the outside. In one example, the remaining-toner-amount detecting device 1 includes the pair of reference electrodes 160 in the vicinity of the supply channels 8 for the respective toners, so that the length of the electric wires 161 of the reference capacitive sensor 16 and the length of the electric wires 151 of the toner-detecting capacitive sensors 15 are set to be substantially the same.

The reference capacitive sensor 16 thus configured is free from the influence of the toners and does not cause a capacitance error component due to sticking of the toners, unlike the toner-detecting capacitive sensors 15 disposed in the respective supply channels 8 for the toners.

The pairs of detection electrodes 150 and the pair of reference electrodes 160 are not limited to having the same shape and the same interval, and may have different shapes and different intervals. This is because, if the capacitance detected by the reference capacitive sensor 16 is used as reference data and the difference of the capacitance at each pair of detection electrodes 150 is calculated and stored, threshold value setting and calibration processing can be performed using the difference. That is, the remaining-toner-amount detecting device 1 uses the capacitance detected by the reference capacitive sensor 16 to be able to accurately set the determination threshold value Th and perform calibration for aging or in maintenance of the toner-detecting capacitive sensors 15.

Figure 4:
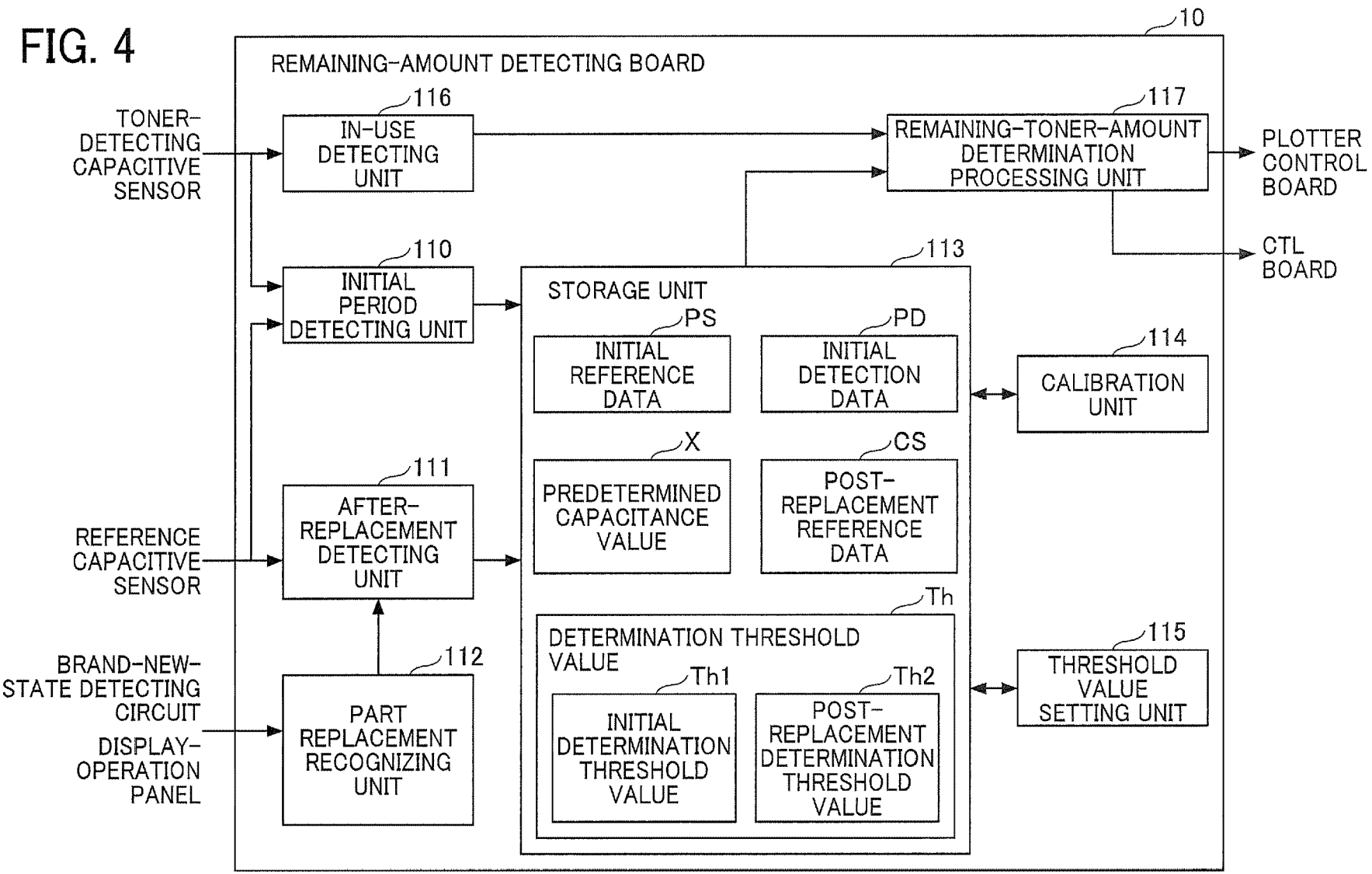
FIG. 4 is a block diagram illustrating functional blocks of a remaining-amount detecting board.

FIG. 4 is a block diagram illustrating functional blocks of the remaining-amount detecting board 10. The remaining-amount detecting processor 11 executes the detection program stored in the FROM 121 to implement functional blocks illustrated in FIG. 4. In the remaining-amount detecting board 10, an initial period detecting unit 110, an after-replacement detecting unit 111, a part replacement recognizing unit 112, a storage unit 113, a calibration unit 114, a threshold value setting unit 115, an in-use detecting unit 116, a remaining-toner-amount determination processing unit 117. The remaining-amount detecting board 10 uses a memory area of the EEPROM 122 as the storage unit 113.

In the initial period (from shipment of the image forming apparatus 100 from a factory to installation of the toner bottle 6), the initial period detecting unit 110 uses the toner-detecting capacitive sensors 15 and the reference capacitive sensor 16 to measure capacitances. The initial period detecting unit 110 then stores, as initial detection data PD, the capacitances detected by the respective toner-detecting capacitive sensors 15 in the storage unit 113, and stores, as initial reference data PS, the capacitance detected by the reference capacitive sensor 16 in the storage unit 113.

By contrast, the after-replacement detecting unit 111 uses the reference capacitive sensor 16 to measure a capacitance in response to a part replacement command from the part replacement recognizing unit 112 after the service person replaces a part of the remaining-toner-amount detecting device 1. Examples of the "part replacement" in this embodiment include replacement of the remaining-amount detecting board 10, replacement of an electronic part in the remaining-amount detecting board 10, replacement of the detection electrodes 150, or replacement of the electric wires 151.

After measuring the capacitance with the reference capacitive sensor 16 in response to the part replacement command from the part replacement recognizing unit 112, the after-replacement detecting unit 111 stores the measured capacitance as post-replacement reference data CS in the storage unit 113.

The part replacement recognizing unit 112 uses an appropriate recognition method to recognize part replacement in the remaining-toner-amount detecting device 1. The recognition method for recognizing part replacement in the remaining-amount detecting board 10 is, for example, a first method or a second method.

The first method is as follows. The service person inputs information indicating that a part has been replaced to the display-operation panel 2 in response to part replacement in the remaining-toner-amount detecting device 1. The image forming apparatus 100 then sends part replacement information to the remaining-amount detecting processors 11.

The second method is as follows. The remaining-amount detecting processor 11 recognizes conduction of the brand-new-state detecting circuit 14 through the closed fuse, and thus identifies part replacement.

The part replacement recognizing unit 112 can also recognize part replacement other than replacement of the remaining-amount detecting board 10 based on recognition methods (input by the service person, a reaction in response to conduction at the time of detection of the brand new state) similar to the first and second methods. When replacing the remaining-amount detecting board 10, the service person removes the EEPROM 122 from the original remaining-amount detecting board 10 and installs the EEPROM 122 on the replacement remaining-amount detecting board 10. Thus, the remaining-amount detecting processor 11 of the replacement remaining-amount detecting board 10 can easily use the information, on the remaining-toner-amount detecting device 1, stored in the EEPROM 122 before the replacement.

The calibration unit 114 calculates an initial difference between the initial detection data PD and the initial reference data PS in the initial period, and stores this initial difference in the storage unit 113. That is, the remaining-toner-amount detecting device 1 stores a difference of the capacitance detected by each toner-detecting capacitive sensor 15 from the initial reference data PS (i.e., the capacitance detected by the reference capacitive sensor 16) in advance. Thus, the calibration unit 114 can calibrate, with the initial difference, the toner-detecting capacitive sensor 15 when the toner-detecting capacitive sensor 15 is replaced, for example.

In response to a timing when the initial reference data PS is stored in the storage unit 113, the threshold value setting unit 115 reads the initial reference data PS in the storage unit 113 and sets the determination threshold value Th. For example, the threshold value setting unit 115 adds a predetermined capacitance value X to the initial reference data PS (i.e., the capacitance detected by the reference capacitive sensor 16) to calculate the determination threshold value Th. The predetermined capacitance value X is calculated in advance through a simulation or experiment, and is stored in the storage unit 113. The threshold value setting unit 115 then stores the calculated initial determination threshold value Th1 in the storage unit 113.

In response to storage of the post-replacement reference data CS in the storage unit 113, the threshold value setting unit 115 reads the initial reference data PS and the post-replacement reference data CS in the storage unit 113 and sets the determination threshold value Th again. As described above, when, for example, the remaining-amount detecting board 10 is replaced in part replacement in the remaining-toner-amount detecting device 1, a part variation of an electronic part (such as the remaining-amount detecting processor 11 or the power supply IC 13) may occur. Thus, the threshold value setting unit 115 calculates a difference AS between the initial reference data PS (i.e., the capacitance detected by the reference capacitive sensor 16) and the post-replacement reference data CS, and adds the difference AS to the initial determination threshold value Th1 to calculate the post-replacement determination threshold value Th2. Thus, the threshold value setting unit 115 can suppress the part variation of the electronic part caused by the part replacement.

When the image forming apparatus 100 forms an image on a printing medium, the in-use detecting unit 116 uses each toner-detecting capacitive sensor 15 to measure a capacitance and obtains the measurement result of each toner-detecting capacitive sensor 15. The in-use detecting unit 116 stores the obtained capacitance detected by each toner-detecting capacitive sensor 15 in the memory 12 (such as the volatile memory) and sends the obtained capacitance to the remaining-toner-amount determination processing unit 117.

The remaining-toner-amount determination processing unit 117 recognizes an amount of remaining toner, based on the capacitance detected by each toner-detecting capacitive sensor 15 and received from the in-use detecting unit 116. As described with reference to FIG. 3, the remaining-toner-amount determination processing unit 117 determines the toner present state if the capacitance detected by the toner-detecting capacitive sensor 15 is larger than or equal to the determination threshold value Th (specifically, the initial determination threshold value Th1 or the post-replacement determination threshold value Th2). The remaining-toner-amount determination processing unit 117 then sends information indicating the toner present state to the plotter control board 4. On the other hand, the remaining-toner-amount determination processing unit 117 determines the toner absent state if the capacitance detected by the toner-detecting capacitive sensor 15 is below the determination threshold value Th. The remaining-toner-amount determination processing unit 117 then sends information indicating the toner absent state to the plotter control board 4. Thus, the plotter control processor 40 of the plotter control board 4 controls operations of the toner supply mechanism 7 and the developing device 9 based on the information indicating the toner present state or the toner absent state sent from the remaining-toner-amount detecting device 1.

The remaining-toner-amount determination processing unit 117 further determines the toner end for prompting the service person or user to replace the toner bottle 6 if the capacitance detected by the toner-detecting capacitive sensor 15 is below the determination threshold value Th (specifically, the initial determination threshold value Th1 or the post-replacement determination threshold value Th2) for the predetermined period. In response to determining the toner end, the remaining-toner-amount determination processing unit 117 sends information indicating the toner end to the CTL board 3 or the plotter control board 4. Thus, the CTL board 3 or the plotter control board 4 informs the user of information prompting the user to replace of the toner via the display-operation panel 2 or the external apparatus 102.

The remaining-toner-amount detecting device 1 and the image forming apparatus 100 according to the one embodiment basically have the configuration described above. The method for setting the determination threshold value Th of the remaining-toner-amount detecting device 1 will be described below.

Figure 5B:
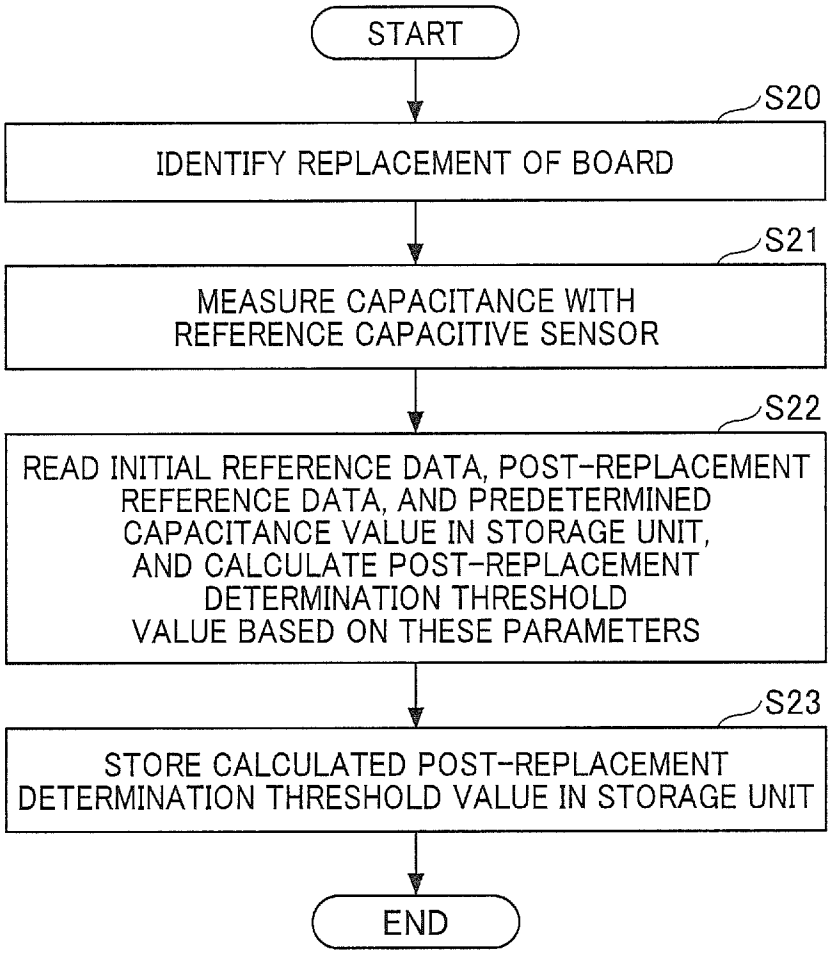
FIG. 5B is a flowchart of a method for setting a post-replacement determination threshold value.
Figure 5A:
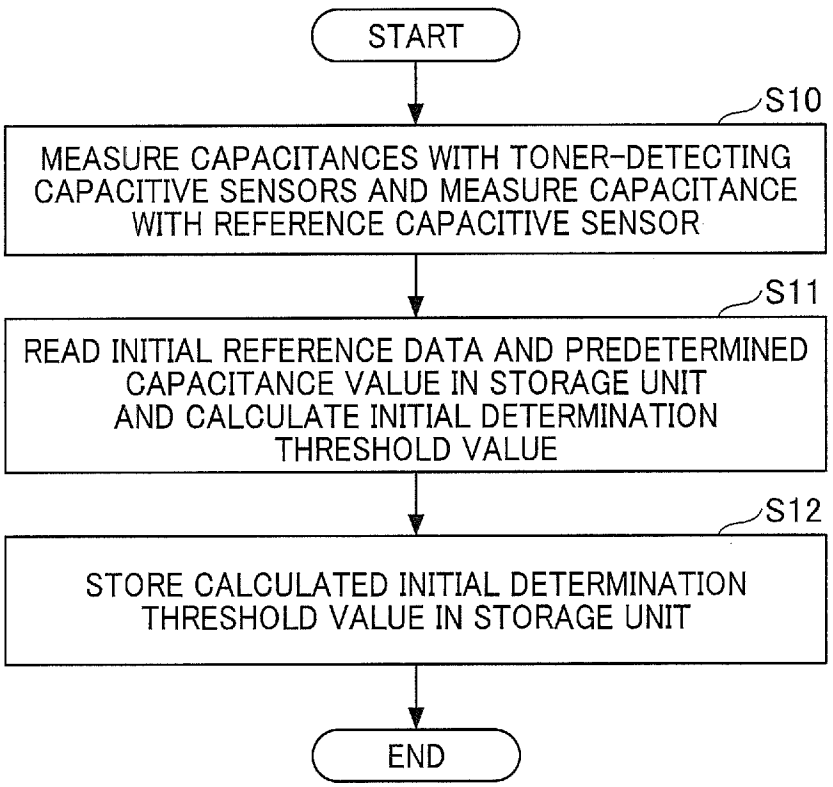
FIG. 5A is a flowchart of a method for setting an initial determination threshold value.

FIG. 5A is a flowchart illustrating a method for setting the initial determination threshold value Th1. As described above, the remaining-amount detecting board 10 sets the initial determination threshold value Th1 in the initial period from shipment of the image forming apparatus 100 from a factory to installation of the toner bottle 6. Other examples of a time when the initial determination threshold value Th1 is set include a time when booting is checked after production, a time when the product is checked at the time of shipment from the factory, and a time when the image forming apparatus 100 is booted for the first time when the image forming apparatus 100 is installed at a place where the image forming apparatus 100 is used.

The remaining-amount detecting board 10 automatically starts setting the initial determination threshold value Th1 in response to booting of the remaining-toner-amount detecting device 1 in the initial period. At this time, the initial period detecting unit 110 uses the toner-detecting capacitive sensors 15 to measure capacitances (i.e., the initial detection data PD) and uses the reference capacitive sensor 16 to measure a capacitance (i.e., the initial reference data PS) (step S10). That is, the toner-detecting capacitive sensors 15 measure capacitances in a state in which toners have not passed through the respective supply channels 8. The initial period detecting unit 110 then stores the obtained initial detection data PD and the obtained initial reference data PS in the storage unit 113 (i.e., the EEPROM 122). The remaining-amount detecting processor 11 may store the initial detection data PD and the initial reference data PS in the memory 41 (such as the EEPROM 412) of the plotter control board 4.

Thereafter, the threshold value setting unit 115 reads the initial reference data PS and the predetermined capacitance value X in the storage unit 113, and adds the predetermined capacitance value X to the initial reference data PS to calculate the initial determination threshold value Th1 (step S11).

The threshold value setting unit 115 then stores the calculated initial determination threshold value Th1 in the storage unit 113 (i.e., the EEPROM 122) (step S12). The remaining-amount detecting processor 11 may store the calculated initial determination threshold value Th1 in the memory 41 (such as the EEPROM 412) of the plotter control board 4. Thus, the image forming apparatus 100 can avoid a data loss caused by a fault of the EEPROM 122. The fault can also be coped with if the initial detection data PD, the initial reference data PS, the initial determination threshold value Th1, and so on are held in both of the plotter control board 4 and the remaining-amount detecting board 10 in a mirrored manner.

As illustrated in FIG. 3, the initial determination threshold value Th1 set based on the capacitance detected by the reference capacitive sensor 16 is approximate to (substantially equal to) the capacitance detected by each toner-detecting capacitive sensor 15 in the initial period. That is, each toner-detecting capacitive sensor 15 and the reference capacitive sensor 16 detect approximate capacitances in the initial period in which toners have not passed through the respective supply channels 8. Thus, the remaining-toner-amount detecting device 1 can appropriately set the initial determination threshold value Th1.

When the image forming apparatus 100 forms an image after the initial period, the toners are supplied to the respective supply channels 8 and are then sent from the respective supply channels 8 to the developing device 9. At this time, the remaining-toner-amount detecting device 1 compares the capacitance measured by each toner-detecting capacitive sensor 15 with the initial determination threshold value Th1 to monitor the state (the toner present state or the toner absent state) of the toner in the corresponding supply channel 8. If the capacitance measured by the toner-detecting capacitive sensor 15 is below the initial determination threshold value Th1 for the predetermined period, the remaining-toner-amount detecting device 1 can accurately determine the toner end for the toner of the corresponding color.

FIG. 5B is a flowchart illustrating a method for setting the post-replacement determination threshold value Th2. As described above, the remaining-amount detecting board 10 sets the post-replacement determination threshold value Th2 in response to part replacement in the remaining-toner-amount detecting device 1. A case where the remaining-amount detecting board 10 is replaced will be described below.

When replacing the remaining-amount detecting board 10, the service person of the image forming apparatus 100 removes the EEPROM 122 from the original remaining-amount detecting board 10, and installs the EEPROM 122 on the replacement remaining-amount detecting board 10. The service person installs this replacement remaining-amount detecting board 10 at a predetermined position (site where the original remaining-amount detecting board 10 has been located) in the image forming apparatus 100.

Thereafter, in response to booting of the remaining-toner-amount detecting device 1, the part replacement recognizing unit 112 of the remaining-amount detecting processor 11 of the replacement remaining-amount detecting board 10 identifies replacement of the board and recognizes the replacement part (step S20).

In response to a part replacement command from the part replacement recognizing unit 112, the after-replacement detecting unit 111 of the remaining-amount detecting processor 11 automatically measures the capacitance (i.e., the post-replacement reference data CS) with the reference capacitive sensor 16 (step S21). The after-replacement detecting unit 111 then stores the obtained post-replacement reference data CS in the storage unit 113 (i.e., the EEPROM 122).

Figure 6B:
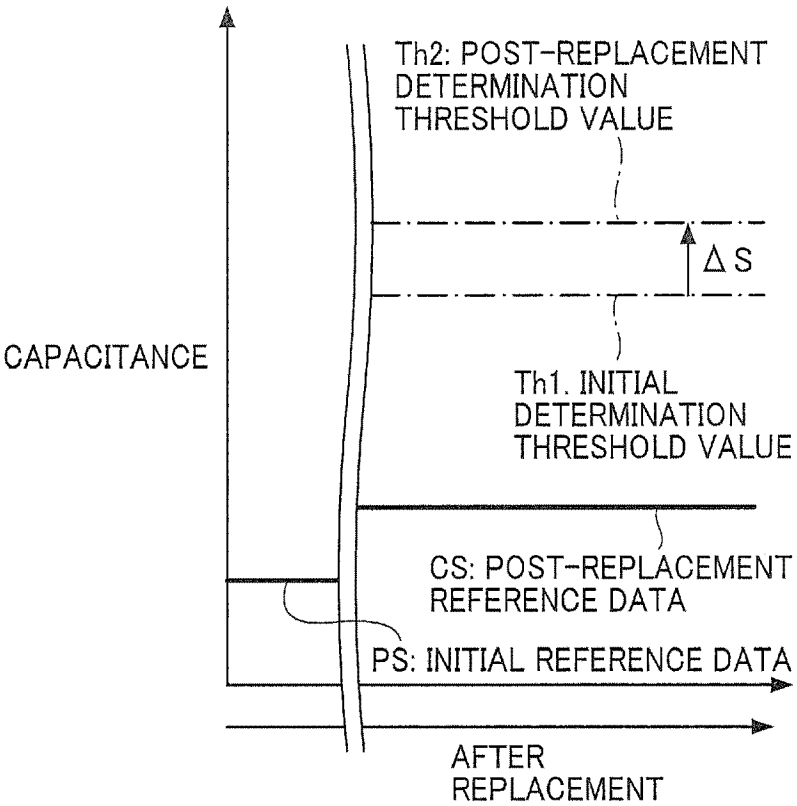
FIGS. 6A and 6B are graphs describing how the post-replacement determination threshold value is set.
Figure 6A:
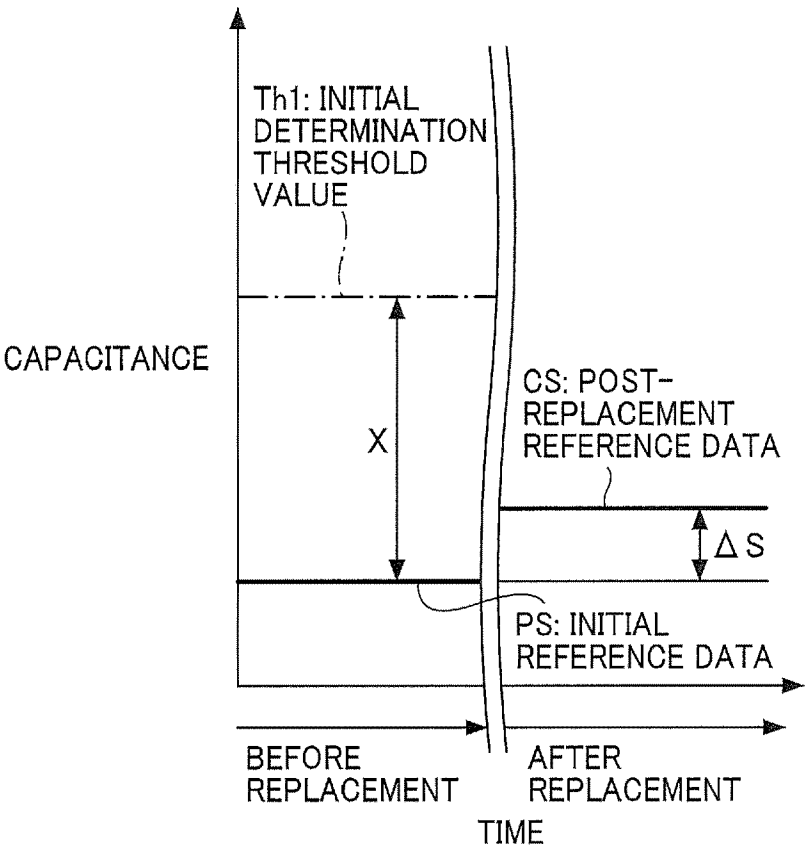

Thereafter, the threshold value setting unit 115 reads the initial reference data PS, the post-replacement reference data CS, and the predetermined capacitance value X in the storage unit 113, and calculates the post-replacement determination threshold value Th2 based on these parameters (step S22). Specifically, as illustrated in FIG. 6A, the threshold value setting unit 115 calculates the difference AS that is an amount of change of the post-replacement reference data CS with respect to the initial reference data PS. The difference ΔS is a signed real number (non-absolute value). FIGS. 6A and 6B illustrate the positive difference ΔS obtained when the post-replacement reference data CS is larger than the initial reference data PS. As illustrated in FIG. 6B, the threshold value setting unit 115 adds the calculated difference ΔS to the initial determination threshold value Th1 to calculate the post-replacement determination threshold value Th2. That is, the threshold value setting unit 115 corrects the initial determination threshold value Th1 based on the post-replacement reference data CS to set the post-replacement determination threshold value Th2.

The threshold value setting unit 115 then stores the calculated post-replacement determination threshold value Th2 in the storage unit 113 (i.e., the EEPROM 122) (step S23).

Thus, the remaining-toner-amount detecting device 1 can appropriately adjust the post-replacement determination threshold value Th2 even if a part variation of the remaining-amount detecting processor 11, the power supply IC 13, or the like is caused by replacement of the board. For example, in a case where a margin of the capacitance detected by the reference capacitive sensor 16 is 30 cnt (C=12 fF), if the voltage applied across the pair of reference electrodes 160 changes by 0.1 V because of the part variation, the capacitance shifts by 100 cnt. By contrast, with the initial reference data PS and the post-replacement reference data CS, the remaining-amount detecting processor 11 can highly accurately correct a change in the determination threshold value Th caused by such a shift.

Thus, when the image forming apparatus 100 forms an image after the part replacement, the remaining-toner-amount detecting device 1 compares the capacitance measured by each toner-detecting capacitive sensor 15 with the post-replacement determination threshold value Th2 to be able to favorably monitor the state of the toner in the corresponding supply channel 8. If the capacitance measured by each toner-detecting capacitive sensor 15 is below the post-replacement determination threshold value Th2 for the predetermined period, the remaining-toner-amount detecting device 1 can accurately determine the toner end for the toner of the corresponding color.

How the post-replacement determination threshold value Th2 is calculated is not limited to adding the difference ΔS between the post-replacement reference data CS and the initial reference data PS to the initial determination threshold value Th1, and the remaining-amount detecting board 10 may use various setting methods. For example, the remaining-amount detecting board 10 may add the predetermined capacitance value X to the post-replacement reference data CS to calculate the post-replacement determination threshold value Th2.

As described above, the remaining-toner-amount detecting device 1 and the image forming apparatus 100 use the capacitance detected by the reference capacitive sensor 16 (second sensor) to set the determination threshold value Th. Thus, the remaining-toner-amount detecting device 1 and the image forming apparatus 100 can accurately set the determination threshold value Th. That is, the reference capacitive sensor 16 located at a position different from the supply channels 8 outputs a measurement result that is not influenced by the toners, to the remaining-amount detecting board 10 (detection processing circuitry). The remaining-amount detecting board 10 sets the initial determination threshold value Th1 based on the initial reference data PS obtained in the initial period and sets the post-replacement determination threshold value Th2 based on the post-replacement reference data CS obtained after part replacement. Thus, the remaining-amount detecting board 10 can suppress an error due to a part variation caused by the part replacement. The remaining-amount detecting board 10 can accurately detect the toner end based on the set determination threshold value Th (i.e., the initial determination threshold value Th1 or the post-replacement determination threshold value Th2).

As described above, the remaining-toner-amount detecting device may use capacitive sensors as detection sensors to reduce the cost and save space. Each capacitive sensor includes a pair of electrodes that face each other in a supply channel for a toner and detects a capacitance according to the toner accumulated in the supply channel. However, when the capacitive sensors of this kind are used, the toner sticks to the electrodes and the determination threshold value shifts because of an error due to a part variation caused by part replacement. Consequently, the toner end may be inaccurately determined. The remaining-toner-amount detecting device 1 and the image forming apparatus 100 that have the configuration described above can accurately set the determination threshold value and accurately detect the toner end even if the remaining-toner-amount detecting device 1 and the image forming apparatus 100 use capacitive sensors.

The remaining-amount detecting board 10 adds the predetermined capacitance value X to the initial reference data PS to set the initial determination threshold value Th1. Thus, the remaining-toner-amount detecting device 1 can easily set the initial determination threshold value Th1.

The remaining-amount detecting board 10 calculates the difference ΔS between the initial reference data PS and the post-replacement reference data CS and adds the difference ΔS to the initial determination threshold value Th1 to set the post-replacement determination threshold value Th2. Thus, the remaining-toner-amount detecting device 1 can accurately set the post-replacement determination threshold value Th2.

The initial period is a period from shipment from a factory to installation of the toner bottles 6. Thus, the remaining-toner-amount detecting device 1 can favorably set the determination threshold value Th before the toner is supplied to the supply channel 8.

When the remaining-amount detecting board 10 is booted in the initial period, the remaining-amount detecting board 10 automatically sets the initial determination threshold value Th1. Thus, the remaining-toner-amount detecting device 1 can reduce the work load of the service person or user and smoothly set the initial determination threshold value Th1.

In response to recognition of part replacement information after part replacement, the remaining-amount detecting board 10 automatically sets the post-replacement determination threshold value Th2. Thus, the remaining-toner-amount detecting device 1 can reduce the work load of the service person or user and smoothly set the post-replacement determination threshold value Th2.

The nonvolatile memory 120 is removably installed on the remaining-amount detecting board 10. Thus, the remaining-toner-amount detecting device 1 can easily use the information stored in the nonvolatile memory 120 even if the board is replaced in part replacement.

Each toner-detecting capacitive sensor 15 includes the pair of detection electrodes 150 that face each other on the inner circumferential surface of the supply channel 8. The reference capacitive sensor 16 includes the pair of reference electrodes 160 that have the same shape as the pair of detection electrodes 150 and are disposed at the same interval as that of the pair of detection electrodes 150. Thus, the capacitance detected by each toner-detecting capacitive sensor 15 and the capacitance detected by the reference capacitive sensor 16 are approximate to each other. Thus, the remaining-toner-amount detecting device 1 can more accurately set the determination threshold value Th.

The remaining-amount detecting board 10 stores, as the initial detection data PD in the nonvolatile memory 120, the capacitance detected by each toner-detecting capacitive sensor 15 in the initial period. In response to replacement of the toner-detecting capacitive sensor 15, the remaining-amount detecting board 10 calibrates the replacement toner-detecting capacitive sensor 15 based on the initial reference data PS and the post-replacement reference data CS. Thus, the remaining-toner-amount detecting device 1 can stabilize the detection accuracy of the toner-detecting capacitive sensor 15 even if the toner-detecting capacitive sensor 15 is replaced.

While the embodiments have been described above, the present disclosure is not limited to the embodiments specifically disclosed above and may be variously modified and altered without departing from the scope of the claims. All the numbers such as ordinal numbers and quantities used in the embodiments are merely illustrative to specifically describe the technique of the present disclosure, and the present disclosure is not limited to the illustrative numbers.

Any one of the above-described operations may be performed in various other ways, for example, in an order different from the one described above. The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A remaining-toner-amount detecting device, comprising:

a first sensor disposed at a supply channel for a toner;

a second sensor disposed at a location different from the supply channel;

detection processing circuitry configured to compare a capacitance detected by the first sensor with a determination threshold value to detect a toner end; and a memory that stores a capacitance detected by the second sensor in an initial period as initial reference data, and a capacitance detected by the second sensor after part replacement as post-replacement reference data, wherein the detection processing circuitry is configured to:

set, based on the initial reference data, the determination threshold value as an initial determination threshold value in the initial period, and re-set the determination threshold value, from the initial determination threshold value, to a value based on the post-replacement reference data, as a post-replacement reference data after the part replacement.

2. The remaining-toner-amount detecting device according to claim 1, wherein the detection processing circuitry is configured to add a predetermined capacitance value to the initial reference data to set the initial determination threshold value.

3. The remaining-toner-amount detecting device according to claim 2, wherein the detection processing circuitry is configured to calculate a difference between the initial reference data and the post-replacement reference data and adds the difference to the initial determination threshold value to set the post-replacement determination threshold value.

4. The remaining-toner-amount detecting device according to claim 1, wherein the detection processing circuitry is configured to automatically set the initial determination threshold value in response to booting of the detection processing circuitry in the initial period.

5. The remaining-toner-amount detecting device according to claim 1, wherein the detection processing circuitry is configured to automatically set the post-replacement determination threshold value in response to recognition of part replacement information after the part replacement.

6. The remaining-toner-amount detecting device according to claim 1, wherein the memory includes a nonvolatile memory removable from the detection processing circuitry.

7. The remaining-toner-amount detecting device according to claim 1, wherein the first sensor includes a pair of detection electrodes facing each other on an inner circumferential surface of the supply channel, and the second sensor includes a pair of reference electrodes having a shape identical to a shape of the pair of detection electrodes and disposed at an interval identical to an interval of the pair of detection electrodes.

8. The remaining-toner-amount detecting device according to claim 1, wherein the detection processing circuitry is configured to:

store, as initial detection data in the memory, a capacitance detected by the first sensor in the initial period; and calibrate the first sensor, based on the initial reference data and the initial detection data, in response to replacement of the first sensor.

9. An image forming apparatus comprising:

the remaining-toner-amount detecting device according to claim 1; and plotter control circuitry configured to control operation of a toner supply mechanism to guide toner into the supply channel.

10. The image forming apparatus according to claim 9, wherein the initial period is a period from shipment of the image forming apparatus from a factory to installation of a toner bottle in the image forming apparatus.

11. A remaining-toner-amount detecting device, comprising:

first capacitance detecting means for detecting a capacitance at a supply channel for a toner;

second capacitance detecting means for detecting a capacitance at a location different from the supply channel;

remaining-amount detecting means for detecting a toner end based on comparison between the capacitance detected by the first capacitance detecting means and a determination threshold value; and storage means for storing a value of the capacitance detected by the second capacitance detecting means in an initial period as initial reference data, and a value of a capacitance detected by the second capacitance detecting means after part replacement as post-replacement reference data, wherein the remaining-amount detecting means is configured to:

set, based on the initial reference data, the determination threshold value as an initial determination threshold value in the initial period, and re-set the determination threshold value, from the initial determination threshold value, to a value based on the post-replacement reference data, as a post-replacement reference data after the part replacement.

12. The remaining-toner-amount detecting device according to claim 11, wherein the remaining-amount detecting means adds a predetermined capacitance value to the initial reference data to set the initial determination threshold value.

13. The remaining-toner-amount detecting device according to claim 12, wherein the remaining-amount detecting means calculates a difference between the initial reference data and the post-replacement reference data and adds the difference to the initial determination threshold value to set the post-replacement determination threshold value.

14. The remaining-toner-amount detecting device according to claim 11, wherein the remaining-amount detecting means automatically sets the initial determination threshold value in response to booting of the remaining-amount detecting means in the initial period.

15. The remaining-toner-amount detecting device according to claim 11, wherein the remaining-amount detecting means automatically sets the post-replacement determination threshold value in response to recognition of part replacement information after the part replacement.

16. The remaining-toner-amount detecting device according to claim 11, wherein the storage means is a nonvolatile memory removable from the remaining-amount detecting means.

17. The remaining-toner-amount detecting device according to claim 11, wherein the first capacitance detecting means includes a pair of detection electrodes facing each other on an inner circumferential surface of the supply channel, and the second capacitance detecting means includes a pair of reference electrodes having a shape identical to a shape of the pair of detection electrodes and disposed at an interval identical to an interval of the pair of detection electrodes.

18. The remaining-toner-amount detecting device according to claim 11, wherein the remaining-amount detecting means is configured to:

store, as initial detection data in the storage means, a capacitance detected by the first capacitance detecting means in the initial period; and calibrate the first capacitance detecting means, based on the initial reference data and the initial detection data, in response to replacement of the first capacitance detecting means.

19. An image forming apparatus comprising:

the remaining-toner-amount detecting device according to claim 11; and a toner supply mechanism for guiding toner into the supply channel.

20. The image forming apparatus according to claim 19, wherein the initial period is a period from shipment of the image forming apparatus from a factory to installation of a toner bottle in the image forming apparatus.

* * * * *